United States Patent [19]

Anderson

[11] Patent Number: 4,958,692

[45] Date of Patent: Sep. 25, 1990

[54] DOWNHOLE STABILIZERS

[76] Inventor: Charles A. Anderson, 78A Stanley Street, Aberdeen AB1 6UQ, Great Britain

[21] Appl. No.: 323,575

[22] Filed: Mar. 14, 1989

[30] Foreign Application Priority Data

Mar. 15, 1988 [GB] United Kingdom ..... 8806109

[51] Int. Cl.[5] ..... E21B 17/10

[52] U.S. Cl. ..... 175/323; 175/325

[58] Field of Search ..... 175/325, 323, 408; 166/241

[56] References Cited

U.S. PATENT DOCUMENTS

| | | | |
|---|---|---|---|
| 1,517,027 | 11/1924 | Smith . | |
| 1,699,087 | 1/1929 | Woodmansee et al. | 175/325 |
| 1,801,294 | 4/1931 | Sutton . | |
| 1,877,395 | 9/1932 | Goeser . | |
| 1,913,365 | 6/1933 | Bailey | 175/325 |
| 3,762,828 | 10/1973 | Faber | 175/325 |
| 3,907,048 | 9/1975 | Gray | 175/325 |
| 4,031,974 | 6/1977 | Peterson | 175/334 |
| 4,372,622 | 2/1983 | Cheek | 308/4 A |

FOREIGN PATENT DOCUMENTS

| | | | |
|---|---|---|---|
| 0627230 | 10/1978 | U.S.S.R. | 175/325 |
| 0911007 | 3/1982 | U.S.S.R. | 175/325 |
| 0271839 | 3/1928 | United Kingdom | 175/325 |
| 8101167 | 4/1981 | World Int. Prop. O. . | |

*Primary Examiner*—Bruce M. Kisliuk
*Assistant Examiner*—Terry Lee Melius

[57] ABSTRACT

There is described a downhole stabilizer having a number of spiral fin-like blades. Each blade is provided with a pocket each of which carries an omni-directional rolling element bearing in the form of a ball which is engaged against the wall of the drilled hole.

7 Claims, 4 Drawing Sheets

DOWNHOLE STABILIZERS

This invention relates to downhole stabilisers for use in the drill strings employed to form oil and gas wells.

BACKGROUND OF THE INVENTION

Downhole stabilisers are tools which are coupled into the drill string to bear against the wall of the drilled hole and thus centralise the drill string in the hole. Such stabilisers often have several spiral fin-like blades externally studded with wear-resistant inserts. The gaps between the stabiliser blades allow relatively free passage of drilling mud and fine debris. Although necessary for the stability of drill strings, conventional downhole stabilisers have the disadvantage of presenting frictional resistance to rotation of the drill string in the drilled hole, and frictional resistance to raising and lowering of the drill string in the hole.

A downhole tool not unlike a stabiliser is a device known as a reamer, which serves to smooth and enlarge the drilled hole by means of peripheral cutters carried on the reamer. Some types of reamer are known in which the cutters are in the form of peripherally-mounted rollers which rotate on axes parallel to but offset from the central axis of the drill string. Apart from torque specifically required for reaming, it may be expected that the turning resistance of a roller reamer is lower than for a non-rolling reamer, but undiminished for lifting and lowering. Thus, even if a stabiliser were fitted with rollers to diminish turning friction, friction incurred during lifting and lowering would not be diminished.

It is therefore an object of the present invention to provide a downhole stabiliser in which such problems of friction are obviated or mitigated.

SUMMARY OF THE INVENTION

According to the present invention there is provided a downhole stabiliser mounting a plurality of omni-directional rolling-element bearings each individually singly mounted in respective pockets on the periphery of the stabiliser.

BRIEF DESCRIPTION OF THE DRAWINGS

Embodiments of the invention will now be described, by way of example, with reference to the accompanying drawings, in which.

DESCRIPTION OF PREFERRED EMBODIMENTS

Figure 1:
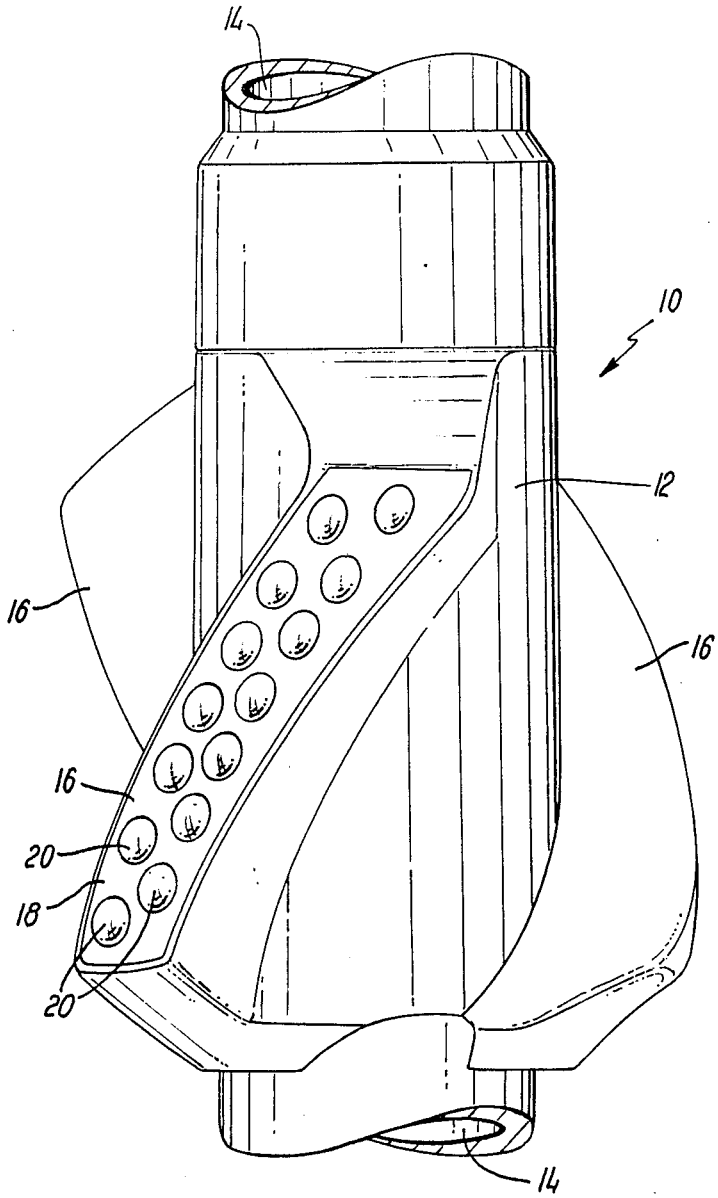
FIG. 1 is an external elevation of a conventional downhole stabiliser modified in accordance with the invention.

Referring first to FIG. 1, this shows an external elevation of a typical downhole stabiliser 10, with end connections omitted. The stabiliser 10 has a generally cylindrical body 12 with a through bore 14 from end to end on the central axis for the passage of drilling fluids and the like. The stabiliser body 12 peripherally mounts three equi-spaced blades 16 which extend along the axial length of the body 12, each in a helical configuration. The outer edge surfaces 18 of the blades 16 will (in normal use) bear against the wall of a hole drilled by a drill string (not shown) of which the stabiliser 10 forms part, as is known in the art of drilling oil and gas wells. The helical configuration of the outer edge surfaces 18 of the blades 16 assist in equalising the distribution of radial loads around the stabiliser 10 in use, while the gaps between the blades 16 permit the upward passage of spent drilling mud and drilling debris past the exterior of the stabiliser 10.

In accordance with the invention, the outer edge surfaces 18 of the blades 16 are each provided with a distributed array of omni-directional rolling element bearings 20, preferably in the form of large-diameter bearing balls as shown in FIG.

1. In one embodiment, the bearing balls 20 may be 2 ¼ inches (5.7 centimetres) in diameter for a blade surface 18 having a width of about five inches (12.7 centimetres). The bearing balls 20 may be equi-spaced in a single row along the length of each blade 16 or may be arranged in two staggered rows down each blade surface 18 to form a zig-zag pattern which maximises the distribution of forces in use. Each bearing ball 20 will normally be held partly recessed in a respective pocket formed in the blades 16, as will now be described.

Figure 2:
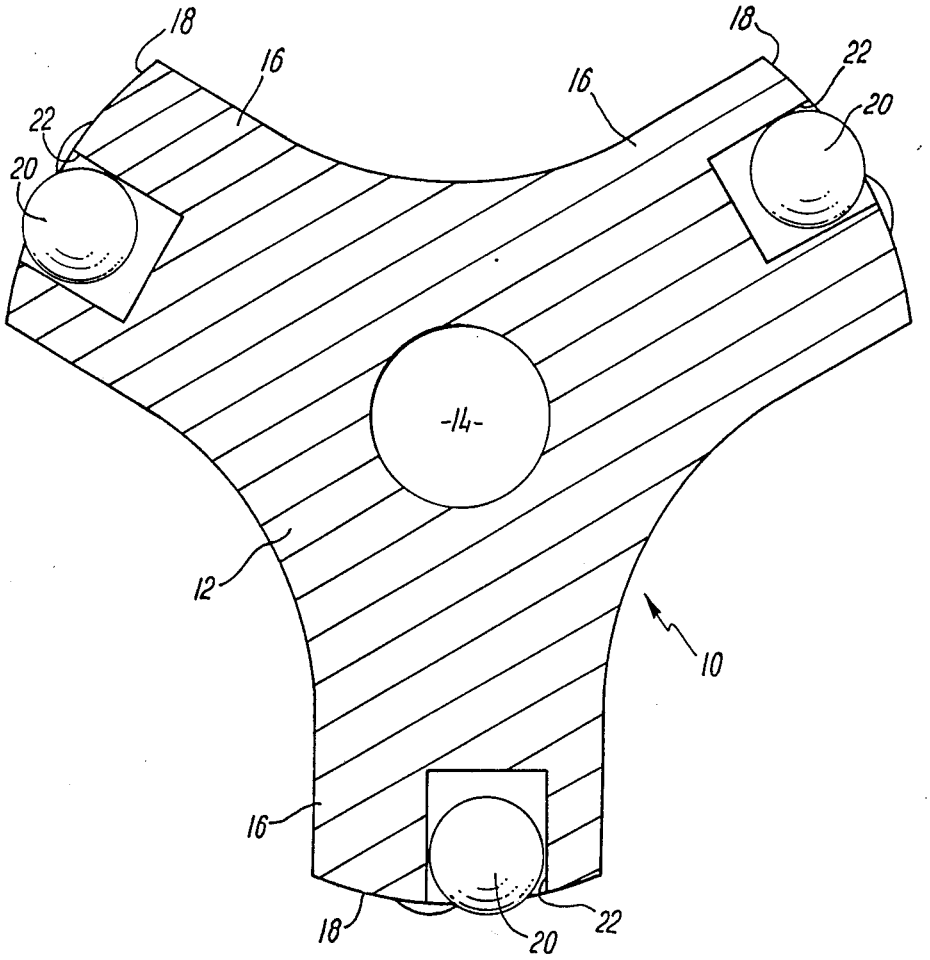
FIG. 2 is a transverse cross-section of a downhole stabiliser similar to that shown in FIG. 1.

Referring now to FIG. 2, this illustrates a transverse cross-section through the stabiliser 10 at the mid-point of one triplet of bearing balls 20. Each of the bearing balls 20 is couched in a respective cylindrical pocket 22 drilled or otherwise formed in the outer edge surfaces 18 of the blades 16, and extending into the body of the respective blade 16 in a direction which is approximately radial to the stabiliser body 12. The bearing pockets 22 may be plain as shown in FIG. 2, but alternatively the bearing pockets may contain further bearing elements for supporting the bearing balls 20 as will be detailed below with reference to FIGS. 3 and 4.

Figure 3:
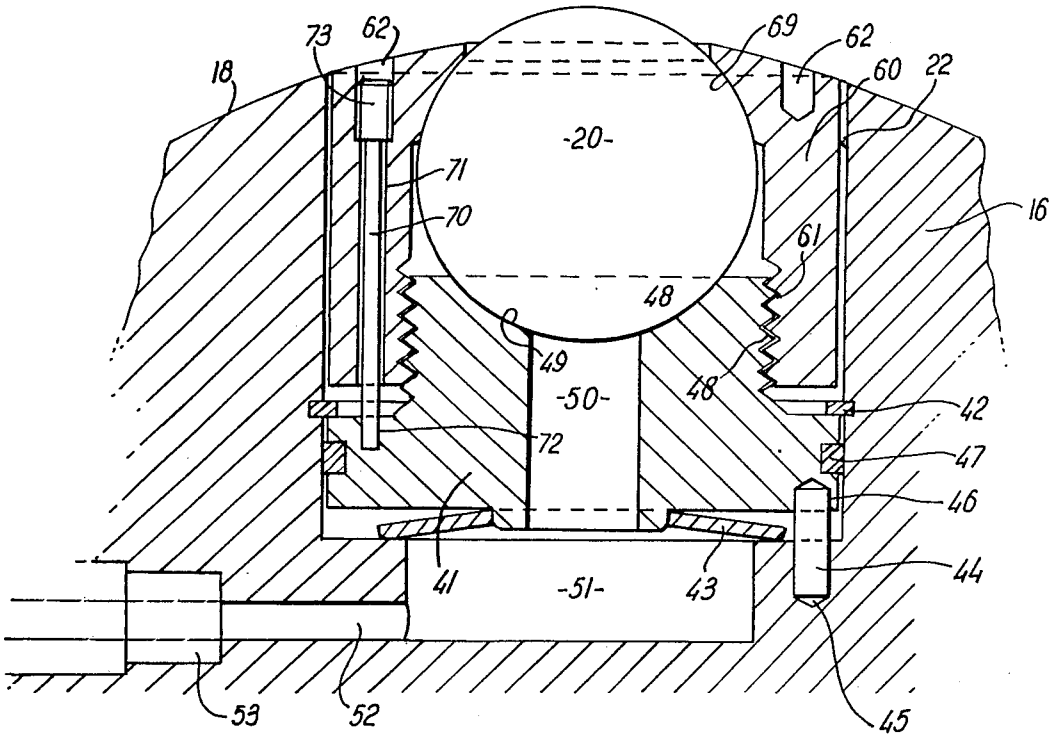
FIG. 3 is a view, to an enlarged scale and in greater detail, of part of the arrangement shown in FIG. 2.

Referring now to FIG. 3, the means for supporting the bearing balls 20 comprise a lower bearing seat 41 which fits within the bearing pocket 22 and is located therein by means of a clip 42. The clip 42 is positioned such as to allow a degree of axial movement of the seat 4, the seat 41 being urged against the clip 42 by a Belleville washer 43 which engages the bottom surface of the pocket 22 and the lower surface of the seat 41.

The seat 41 is prevented from rotating by an anti-twist dowel 44 which is located within a blind hole 45 in the body of the blade 16 and a corresponding blind hole 46 in the lower seat 41. A seal 47 seals the outer circumferential surface of the seat 41 against the inner surface of the pocket 22.

The lower seat 41 is also provided with a central through bore 50 which communicates with a grease sump 51 below the pocket 22 and into which grease or any other suitable fluid may be pumped through channel 52 and non-return valve shown schematically at 53.

The bearing ball 20 is held against the spherical upper bearing surface 49 of the lower seat 41 by a cylindrical cap 60 which is internally threaded at 61 to engage corresponding external threading 48 on the lower seat 41. The cap 60 has a downwardly facing bearing surface 69 which retains the bearing ball 20 at a pressure determined by the extent to which the cap 60 is screwed onto the lower seat 41. This is achieved by the use of a tool which engages openings 62 formed in the upper surface of the cap 60. The cap and lower seat 41 are retained in their relative position by a lock pin 70 which passes through a through hole 71 in the cap 60 and engages a blind hole 72 in the lower seat 41. The locking pin 70 is in turn held in position by a grub screw 73 located in one of the holes 62.

The arrangement above-described permits adequate lubrication of the bearing ball 20, allowing its free rotation whilst permitting a degree of radial movement (relative to the blade 16). This radial movement is controlled by the hydraulic pressure created by the grease in the grease sump 51 which is in turn generated by movement of the lower seat 41 against the action of the Belleville washer 43.

Figure 4:
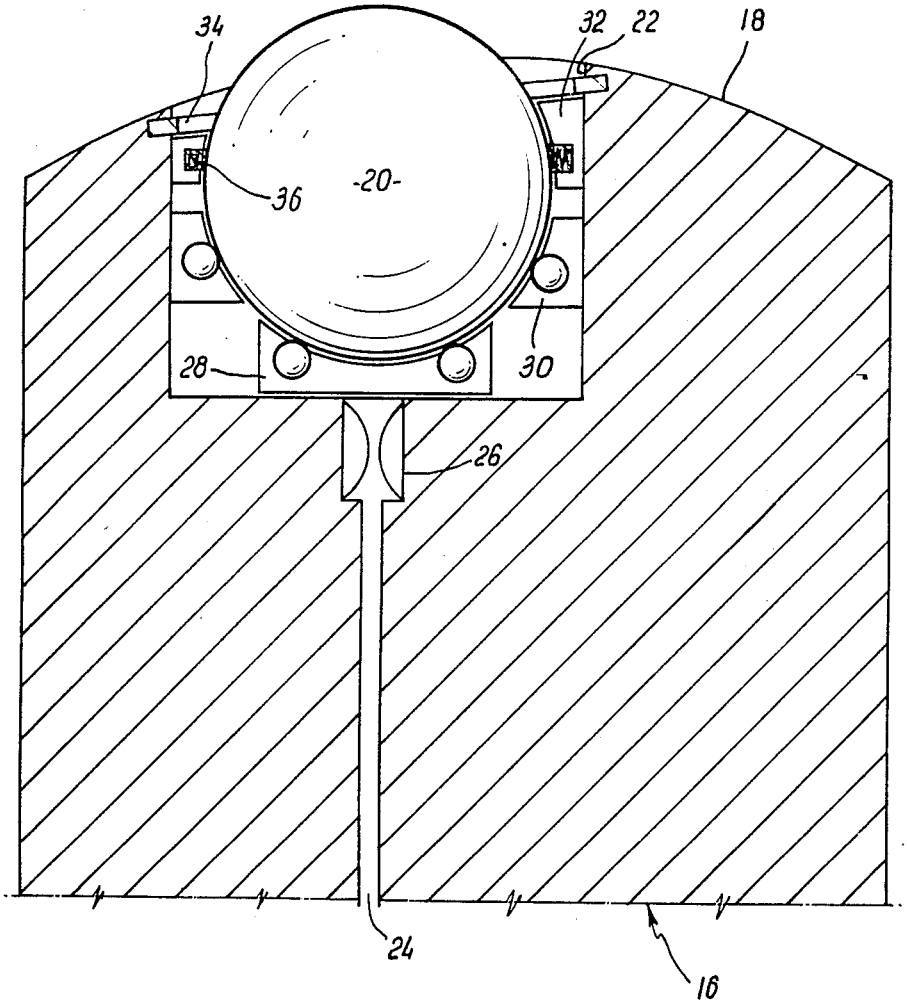
FIG. 4 is a view corresponding to FIG. 3 of a modified embodiment.

In the embodiment illustrated in FIG. 4, each of the bearing pockets 22 is connected by an approximately radial passage 24 to the stabiliser central bore 14. The passages 24 transfer pressurised drilling mud from the bore 14 to the pockets 22, and hence to the undersides of the bearing balls 20. Each of the passages 14 preferably contains a flow-throttling jet 26 which is selected to control the pressure and flow rate of mud from the bore 14 to values which balance the inward loads on the bearing balls 20 from their contact with the wall of the hole being drilled. (The balancing case is "inward load equals product of mud pressure on underside of bearing ball and diametral area cf bearing ball"). The outward flow of mud to each pocket 22 and its respective bearing ball 20 assists in cooling and debris clearance as well as lubrication. Provision is preferably made so that the normal operating positions of the bearing balls 20 is slightly protruding from each respective bearing pocket 22, and hence from the respective stabiliser blade surface 18, as shown in FIG. 4. Such provision can include controlled hydraulic pressurisation and/or any suitable form of mechanical support or ball movement limitation; in the simplest case, the pockets 22 can be drilled to a pre-selected depth suitably less than the diameter of the bearing balls 20.

In the arrangement illustrated in FIG. 4, the bearing ball 20 is positively supported against inward loads by a configuration of ball races 28 and 30, each consisting of a respective static ball race holding an array of caged or uncaged bearing balls which are individually small relative to the main bearing ball 20.

The bearing ball 20 is restrained from escaping outwardly from the pocket 22, and axially centred within the pocket 22, by a retaining collar 32. The collar 32, and hence the bearing ball 20, is retained within the pocket 22 by a circlip 34 which is fitted into a circumferential groove just inside the mouth of the pocket 22.

The retaining collar 32 preferably incorporates a spring-loaded wiper ring 36 to assist in keeping unwanted solids (such as drilling debris) out of the pocket 22. Maintenance of the pocket 22 free of unwanted solids is assisted by the supply of pressurised drilling mud through the bore 24 and the flow-graduating jet 26, this flow also providing lubrication and cooling.

The downhole stabiliser with omni-directional rolling element bearings of the invention gives a significant reduction in friction forces when employed in place of a conventional stabiliser with blades having no moving parts. In particular, a reduction of about twenty-five per cent in drilling torque is expected, as well as a considerable reduction in vertical friction during tripping (vertical withdrawal and return of the drill string, for example when replacing a drill bit).

While a number of variations and alternatives have been described, and shown in the accompanying drawings, the invention is not limited thereto in that other modifications and variations are possible withOut departing from the scope of the invention.

I claim:

1. A downhole stabiliser comprising a generally cylindrical body having a through bore, said body peripherally mounting a plurality of radially extending blades each also extending along the axial length of the body and having outer edge surfaces defining a periphery of said stabiliser, said blades having gaps therebetween allowing passage of fluid past the exterior of said stabiliser, said stabiliser mounting a plurality of omni-directional rolling-element bearings each individually mounted in a respective pocket on the periphery of the radially extending blades said pockets being distributed in a number of arrays.

2. A stabiliser as claimed in claim 1, comprising three equi-spaced blades, each in a helical configuration.

3. A stabiliser as claimed in claim 1, wherein the omni-directional rolling element bearings are balls.

4. A stabiliser as claimed in either claim 1, wherein said arrays distribute forces exerted by the stabiliser on the wall of a drilled hole.

5. A stabiliser as claimed in claim 1, wherein the rolling element bearings are retained in the respective pockets by a two-piece lower seat and cap arrangement.

6. A stabiliser as claimed in claim 5, wherein the rolling element bearing is mounted so as to permit axial motion controlled by hydraulic pressure resulting from a fluid sump located at the bottom of each pocket.

7. A stabiliser as claimed in claim 1, wherein the rolling element bearings are fed with a controlled flow of pressure drilling mud to lubricate the bearings and to assist in keeping them free from debris.

* * * * *